US005320438A

United States Patent [19]

Yang

[11] Patent Number: 5,320,438

[45] Date of Patent: Jun. 14, 1994

[54] GRIP FOR WRITING IMPLEMENTS

[76] Inventor: Kuo-Fu Yang, P.O. Box 82-144, Taipei, Taiwan

[21] Appl. No.: 65,403

[22] Filed: May 24, 1993

[51] Int. Cl.[5] ..... B43K 23/00

[52] U.S. Cl. ..... 401/6; 401/88

[58] Field of Search ..... 401/6-8, 401/88; 434/162, 166; 15/443, 445

[56] References Cited

U.S. PATENT DOCUMENTS

| | | | |
|---|---|---|---|
| 336,644 | 2/1886 | Hollwede | 401/6 X |
| 1,184,155 | 5/1916 | Williams | 401/6 X |
| 3,947,977 | 4/1976 | Bishop | 401/6 X |
| 4,123,179 | 10/1978 | Pachico | 401/6 |
| 5,180,239 | 1/1993 | Bistrack | 401/6 |

FOREIGN PATENT DOCUMENTS

| | | | |
|---|---|---|---|
| 2729749 | 1/1979 | Fed. Rep. of Germany | 401/6 |

*Primary Examiner*—Danton D. DeMille
*Attorney, Agent, or Firm*—Alfred Lei

[57] ABSTRACT

This invention relates to a grip for writing implements and in particular to one including a tubular member having a spherical stock at an end, a swelling at an intermediate portion, a recess between the spherical stock and the swelling, and a converging end, the tubular member further having a longitudinal hole and a slot in communication with the longitudinal hole, the slot being formed with two aligned holes and two aligned recesses, and an adjusting member provided with two aligned pins and two aligned protuberances engageable with the aligned holes and the aligned recesses of the slot respectively, the adjusting member further having a rubber projection in an inner side, whereby the grip may facilitate the holding of a writing implement.

1 Claim, 3 Drawing Sheets

GRIP FOR WRITING IMPLEMENTS

BACKGROUND OF THE INVENTION

It has been found that the conventional holder for writing implements is simply a straight tubular member which will make the hand of a user tire when holding for a long period of time. Hence, various kind of holding devices for writing implements have been developed to eliminate the defects. However, none of them on the market are satisfactory in use.

Therefore, it is an object of the present invention to provide a grip for writing implements which may obviate and mitigate the above-mentioned drawbacks.

SUMMARY OF THE INVENTION

This invention relates to a grip for writing implements.

It is the primary object of the present invention to provide a grip for writing implements which may facilitate the holding of a writing implement.

It is another object of the present invention to provide a grip for writing implements which is especially useful for writers.

It is still another object of the present invention to provide a grip for writing implements which is easy to use.

It is still another object of the present invention to provide a grip for writing implements which is simple in construction.

It is a further object of the present invention to provide a grip for writing implements which is economic to produce.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
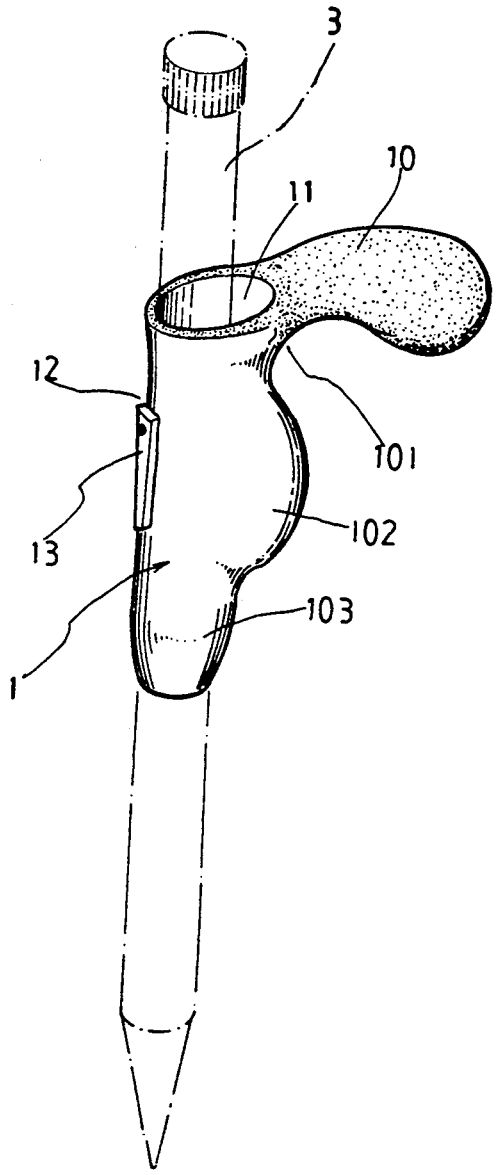
FIG. 1 is a perspective view of the present invention.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

With reference to the drawings and in particular to FIG. 1 thereof, the grip for writing implements according to the present invention comprises a tubular member 1 with a longitudinal hole 11 having a diameter slightly larger than the diameter of a general writing implement 3. Further, the tubular member 1 is formed with a slot 12 which is engageable with an adjusting member 13.

The tubular member 1 is formed with a spherical stock 10 at the tail end, a swelling 102 at the intermediate portion, a recess 101 between the spherical stock 10 and the swelling 102, and a converging end 103. The slot 12 has two aligned holes 121 and two aligned recesses 122.

Figure 2:
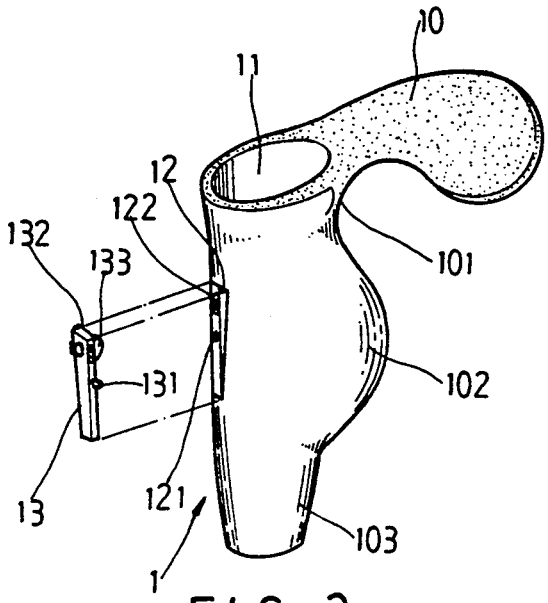
FIG. 2 is an exploded view of the present invention.
Figure 3:
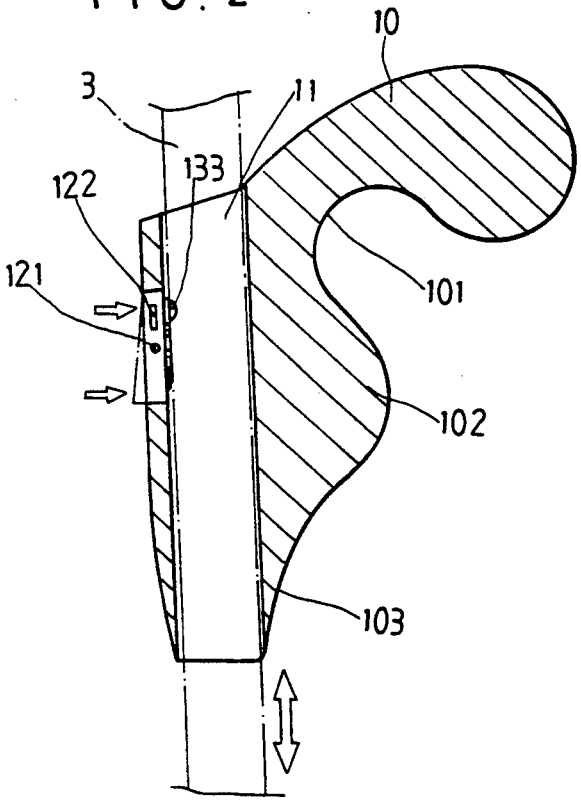
FIG. 3 is a sectional view of the present invention.

As illustrated in FIGS. 2 and 3, the adjusting member 13 is provided with two aligned pins 131 and two aligned protuberances 132 which are engageable with the two aligned holes 121 and the two aligned recesses 122 of the slot 12 of the tubular member 1 respectively. Further, the inner side of the adjusting member 13 has a rubber projection 133.

When in use, simply insert a writing implement 3 into the longitudinal hole 11 of the tubular member 1 and press the upper end of the adjusting member 13 thereby causing the rubber projection 133 bearing against the writing implement 3 and therefore preventing the writing implement 3 from dropping downward. When desired to dismantle the writing implement 3 from the tubular member 1, it is only necessary to press the lower end of the adjusting member 13 so as to release the rubber projection 133 of the adjusting member 13 from the writing implement 3.

Figure 4:
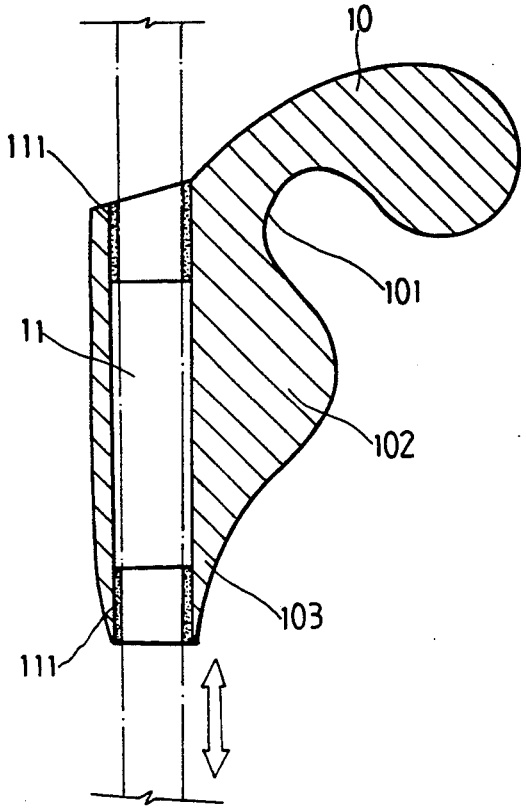
FIG. 4 is a sectional view of a second preferred embodiment of the present invention.

FIG. 4 shows a sectional view of a second preferred embodiment of the present invention. As can be seen, the tubular member 1 is provided with a rubber annular member 11 instead of the adjusting member 13 in the previous embodiment.

Figure 5:
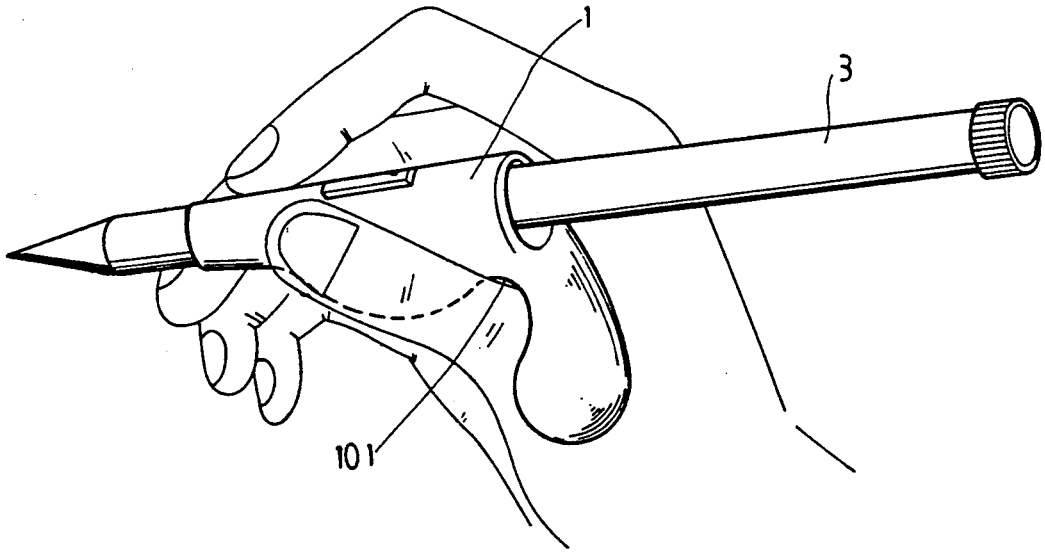
FIG. 5 is a working view of the present invention.

FIG. 5 shows a working view of the present invention. As illustrated, the writing implement 3 may be conveniently held by a hand of a user thereby facilitating the holding of the the writing implement 3.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A grip for writing implements comprising:

a tubular member having a spherical stock at an end, a swelling at an intermediate portion, a recess between said spherical stock and said swelling, and a converging end, said tubular member further having a longitudinal hole and a slot in communication with said longitudinal hole, said slot being formed with two aligned holes and two aligned recesses; and an adjusting member provided with two aligned pins and two aligned protuberances engageable with the aligned holes and the aligned recesses of said slot respectively, said adjusting member further having a rubber projection in an inner side.

* * * * *